US007171907B2

(12) United States Patent
Early

(10) Patent No.: US 7,171,907 B2
(45) Date of Patent: Feb. 6, 2007

(54) DRIVE SYSTEM FOR A RAILWAY HOPPER CAR DISCHARGE GATE

(75) Inventor: Stephen R. Early, Olathe, KS (US)

(73) Assignee: Aero Transportation Products, Independence, MO (US)

( * ) Notice: Subject to any disclaimer, the term of this patent is extended or adjusted under 35 U.S.C. 154(b) by 24 days.

(21) Appl. No.: 10/857,335

(22) Filed: May 28, 2004

(65) Prior Publication Data

US 2005/0263031 A1 Dec. 1, 2005

(51) Int. Cl.
*B61D 3/00* (2006.01)

(52) U.S. Cl. ..... 105/247

(58) Field of Classification Search ..... 105/247, 105/254, 248, 305; 74/460; 414/505; 49/361
See application file for complete search history.

(56) References Cited

U.S. PATENT DOCUMENTS

| | | | | |
|---|---|---|---|---|
| 318,692 | A * | 6/1885 | Crump et al. | 299/39.8 |
| 3,245,359 | A * | 4/1966 | Floehr | 105/305 |
| RE28,926 | E | 8/1976 | Baxter, Jr. | |
| RE29,115 | E | 1/1977 | Rouverol | |
| 4,036,149 | A | 7/1977 | White | |
| 4,256,042 | A | 3/1981 | Fischer | |
| 4,452,149 | A | 6/1984 | LeMarbe | |
| 4,454,822 | A | 6/1984 | Fischer | |
| 4,542,701 | A | 9/1985 | Fischer | |
| 4,601,244 | A | 7/1986 | Fischer | |
| 4,606,276 | A | 8/1986 | LeMarbe | |
| 4,617,868 | A | 10/1986 | Wahlstrom | |
| 4,869,023 | A | 9/1989 | Bakula | |
| 4,879,920 | A | 11/1989 | Kerkhoff | |
| 4,899,609 | A | 2/1990 | Nagata | |
| 5,005,490 | A | 4/1991 | Overheldt | |
| 5,083,474 | A | 1/1992 | Rouverol | |
| 5,086,709 | A | 2/1992 | Fischer | |
| 5,163,372 | A | 11/1992 | Galvan | |
| 5,271,289 | A | 12/1993 | Baxter, Jr. | |
| 5,353,713 | A | 10/1994 | Dohr | |
| 5,437,232 | A | 8/1995 | Borowski | |
| 5,584,251 | A * | 12/1996 | Lucas | 105/305 |
| 5,671,684 | A | 9/1997 | Lucas | |
| 5,676,265 | A | 10/1997 | Miller | |
| RE35,925 | E | 10/1998 | Dohr | |
| 5,845,796 | A | 12/1998 | Miller | |

(Continued)

*Primary Examiner*—S. Joseph Morano
*Assistant Examiner*—Robert J. McCarry, Jr.
(74) *Attorney, Agent, or Firm*—Chase Law Firm, L.C.

(57) ABSTRACT

A drive system for a railway hopper car discharge gate includes a door panel operated by a rack and pinion drive. The pinion teeth present a substantially cylindrical profile in a plane orthogonal to the axis of pinion rotation. The cylindrical tooth profile substantially prevents the pinion teeth from skipping or walking against the rack teeth when the spacing between the pinion and the door panel and associated rack fluctuates during operation of the discharge gate. Pinion torque is converted into a vertical force at the ends of travel of the door panel to prevent damage to the drive components. A bearing arrangement supports a drive shaft that is operated to rotate the pinions, and minimizes deflection of the shaft when under rotational load. An inertia brake is provided to engage the door panel and prevent it from opening upon a rapid stop of the hopper car as may occur upon impact with an adjacent railway car.

12 Claims, 16 Drawing Sheets

U.S. PATENT DOCUMENTS 6,019,049 A 2/2000 Gaydos
6,227,124 B1 5/2001 Gaydos
6,230,578 B1 5/2001 Kim et al.
6,263,803 B1 7/2001 Dohr
6,264,288 B1 7/2001 Dreese
6,279,487 B1 8/2001 Gaydos
6,286,437 B1 9/2001 Lucas
6,341,422 B1 1/2002 O'Donnell
6,357,361 B2 3/2002 Dohr
6,363,863 B1 * 4/2002 Dohr ..... 105/247
6,398,314 B2 6/2002 Dreese
6,412,421 B2 7/2002 Dohr
6,412,422 B2 7/2002 Dohr
6,431,084 B1 8/2002 Gaydos
6,478,173 B2 11/2002 Carlstedt
6,488,162 B1 12/2002 Carlstedt
6,499,753 B2 12/2002 Irvine et al.
6,520,360 B1 2/2003 Withall
6,571,718 B2 6/2003 Lucas
2001/0015151 A1 8/2001 Dohr
2001/0015152 A1 8/2001 Dohr
2001/0022467 A1 9/2001 Dreese
2003/0015117 A1 1/2003 Gaydos

* cited by examiner

DRIVE SYSTEM FOR A RAILWAY HOPPER CAR DISCHARGE GATE

FIELD OF THE INVENTION

This invention relates to the field of discharge gates for railway hopper cars and, more particularly, to a drive system for moving discharge gate door panels between open and shut positions.

BACKGROUND OF THE INVENTION

Railroad hopper cars are used to transport bulk lading through railway systems. A railroad hopper car typically includes discharge gates located on the underside of the car for unloading the transported materials. Discharge gates typically include one or more sliding door panels that may be selectively moved between open and closed positions to expose or cover an opening in the undercarriage of the car. Typically, an opening and closing drive mechanism shifts a door panel between open and closed positions via a rack or racks fixed to the panel and an operating shaft. The operating shaft carries pinions which engage the racks. The operating shaft is rotated to move the panel in the desired direction. The car may be unloaded by sliding the panel to open the gate and allowing the lading to flow through the opening.

Typically door panels are driven using a rack and pinion system whereby elongated, multitoothed racks are attached along opposing sides of either the upper or lower face of the panel. The rack is engaged by a pinion which is in turn driven by a shaft. The shaft extends outwardly for access and terminates in a socket or other structure that may be engaged by a lever, handle or powered driver used to turn the shaft. Because of its length, as the shaft turns it is subject to undesirable transverse deflection. Additionally, a stop at each end of the rack is engaged by the pinion to limit the travel of the panel, which may cause an impact that can damage the drive components or produce excessive wear over time.

Pinions used in discharge gates are typically circular, external, spur gears having teeth that are either relatively straight-sided or crowned in profile. Crowned tooth profiles include teeth having working surfaces compliant to elliptical, cycloidal, epicycloidal or involute curves. The pitches of the pinion teeth and rack teeth are optimized for engagement with one another. The pitch circle of the pinion ideally bears a relationship to a corresponding pitch line of the rack such that the two pitches will provide a common velocity when the pinion is in rolling contact with the rack.

Lading carried by hopper cars typically includes granular or particulate matter such as sugar, flour, grain, plastic pellets and cement. The weight of the lading in a full hopper car can exert considerable downward force against the door panels causing them to deflect as well as resist movement under load. When the panel deflects, the proximity of the rack to the pinion is altered. As the pinion moves towards or away from the rack the effective pitch of the pinion teeth is changed and thus the rack teeth and pinion teeth may no longer align properly. As a result of this misalignment, the pinion teeth may skip (if the pinion is moved further away from the rack) or climb (if the pinion is moved closer to the rack).

Since discharge gates are subjected to substantial jarring while the hopper car is in use, the door panel should be restrained from opening inadvertently. In particular, the door is subject to inertial forces that would tend to cause it to open when the hopper car is stopped suddenly. To secure the door panel in a closed position, discharge gates are often provided with latches or locks positioned under the panel that may be activated by inertial force during transportation of lading within the hopper car and released prior to opening the discharge gate during unloading.

BRIEF DESCRIPTION OF THE INVENTION

In one aspect of the invention, a drive system for a railway hopper car discharge gate provides a controlled, rack and pinion driven sliding motion for a discharge gate door panel. The discharge gate includes a hopper frame surrounding a central opening. The door panel is movable between frontward and rearward positions to open or close the gate, respectively. A drive shaft passes through the hopper frame transverse to the direction of travel of the door panel, and has a pinion thereon in engagement with an associated rack. The working surfaces of the pinion teeth present a generally cylindrical profile in a plane orthogonal to of the axis of rotation of the pinion, whereby conjugacy may be maintained between the pinion teeth and the rack teeth even as the distance between rack and pinion varies during operation of the drive system. Stop blocks at the respective ends of each rack are sized and positioned to convert pinion torque to a vertical force applied to and opposed by the panel to thereby prevent further travel without damaging drive system components.

In another aspect of the invention, a socket or other means for inducing drive shaft rotation is mounted on an outer end of the drive shaft. A bearing spacer is slidably mounted on the drive shaft between the socket and the pinion. The bearing spacer is a hollow sleeve that supports the drive shaft and substantially prevents shaft deflection under rotational load.

In a further aspect of the invention, an inertia brake is provided and includes a counterweight mounted on a pivotal arm that has a normal position in which a portion of the arm extends downwardly in front of the leading edge of the door panel of a discharge gate to block forward movement of the panel to an open position in response to a forward force caused by a rapid cessation of movement of the hopper car. Normal opening of the door panel to discharge transported material is not prevented by the brake as the absence of an abnormal force permits the arm to swing to a fully released position as the panel shifts to its open position, and then return to the normal, braking position as the panel is closed.

DETAILED DESCRIPTION

Double-Door Discharge Gate

Figure 1:
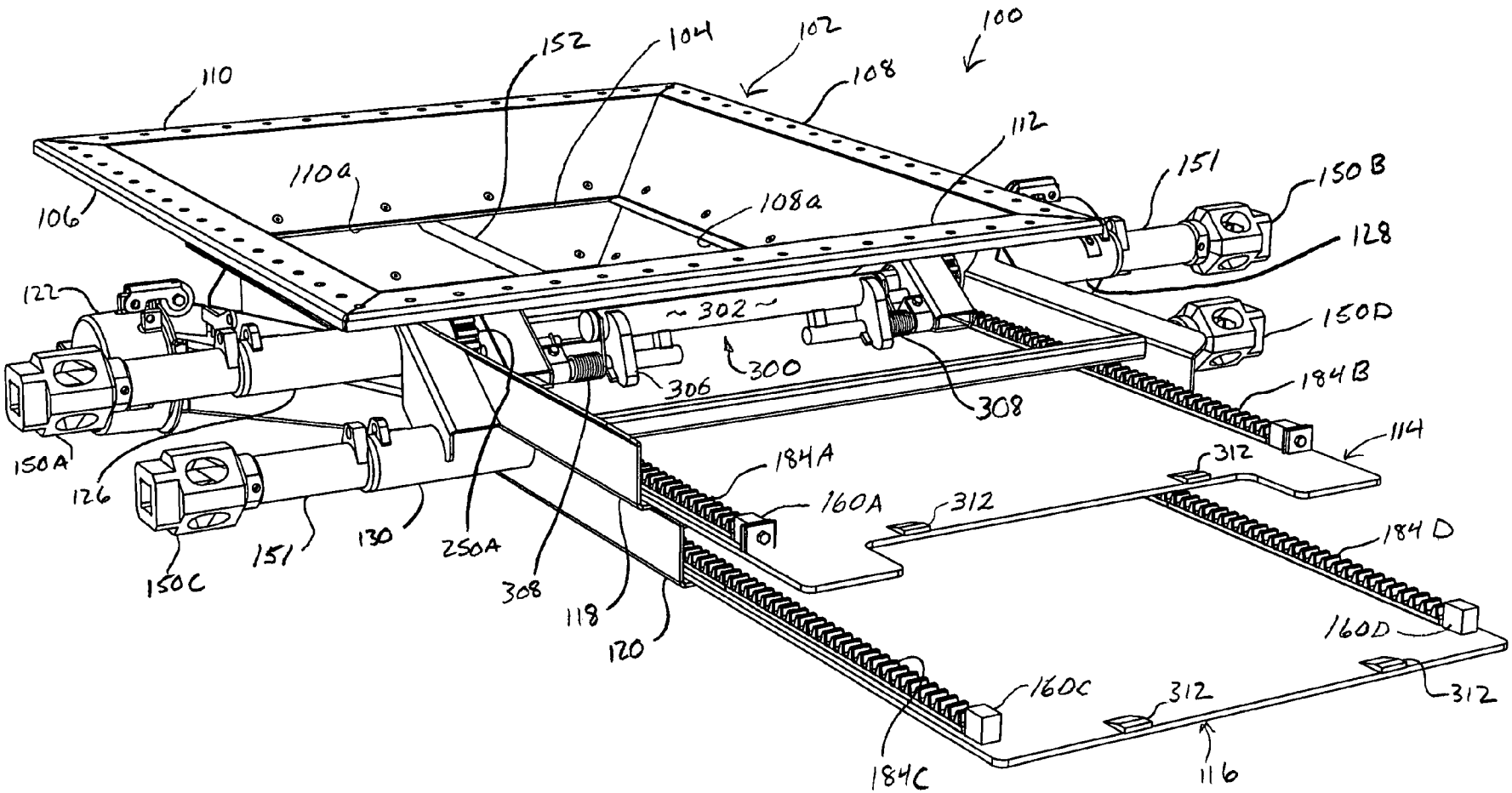
FIG. 1 is a frontal and side perspective view of a two-door, railroad car discharge gate in accordance with an embodiment of the present invention.
Figure 2:
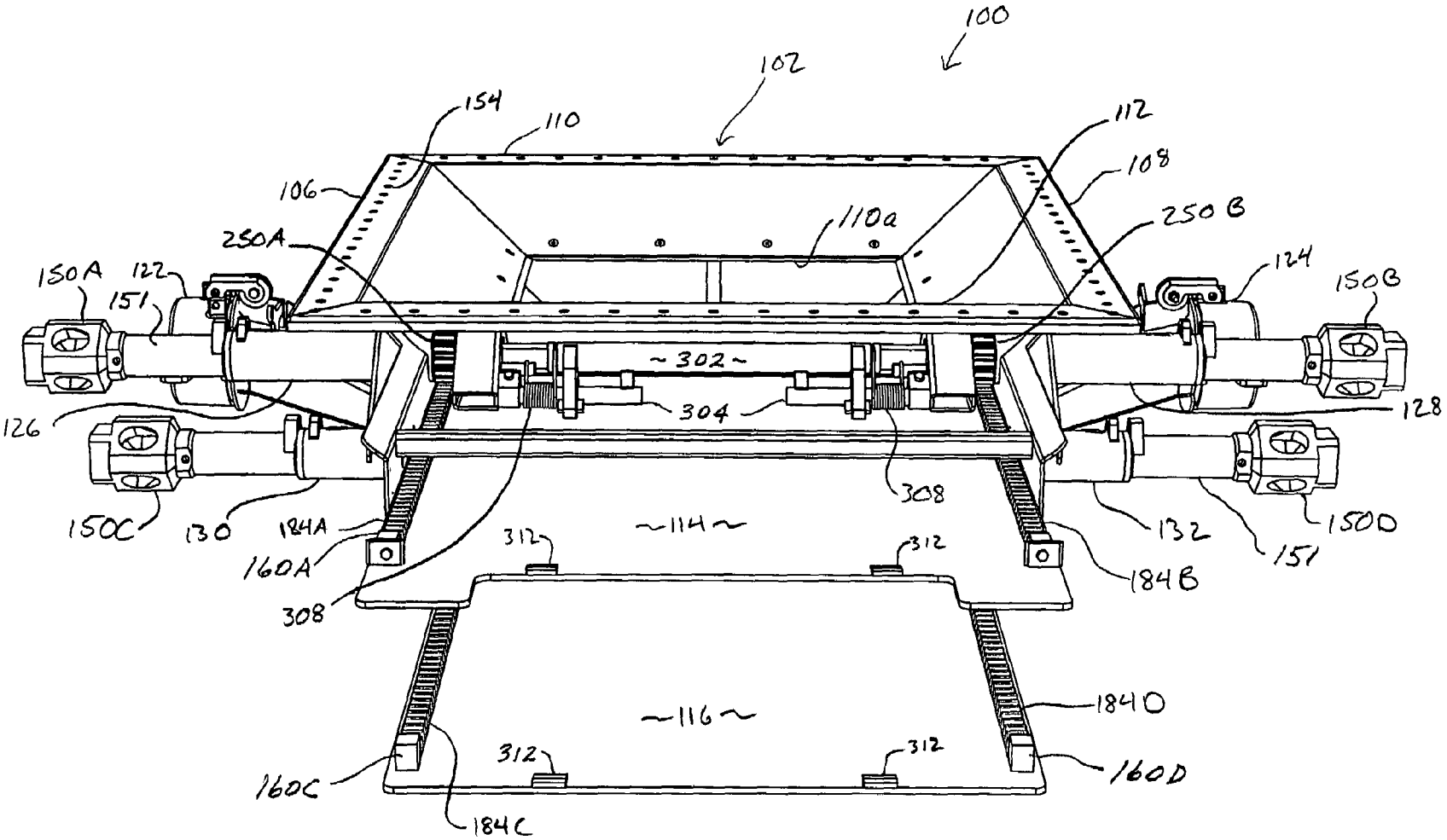
FIG. 2 is an upper, front perspective view of the discharge gate.
Figure 3:
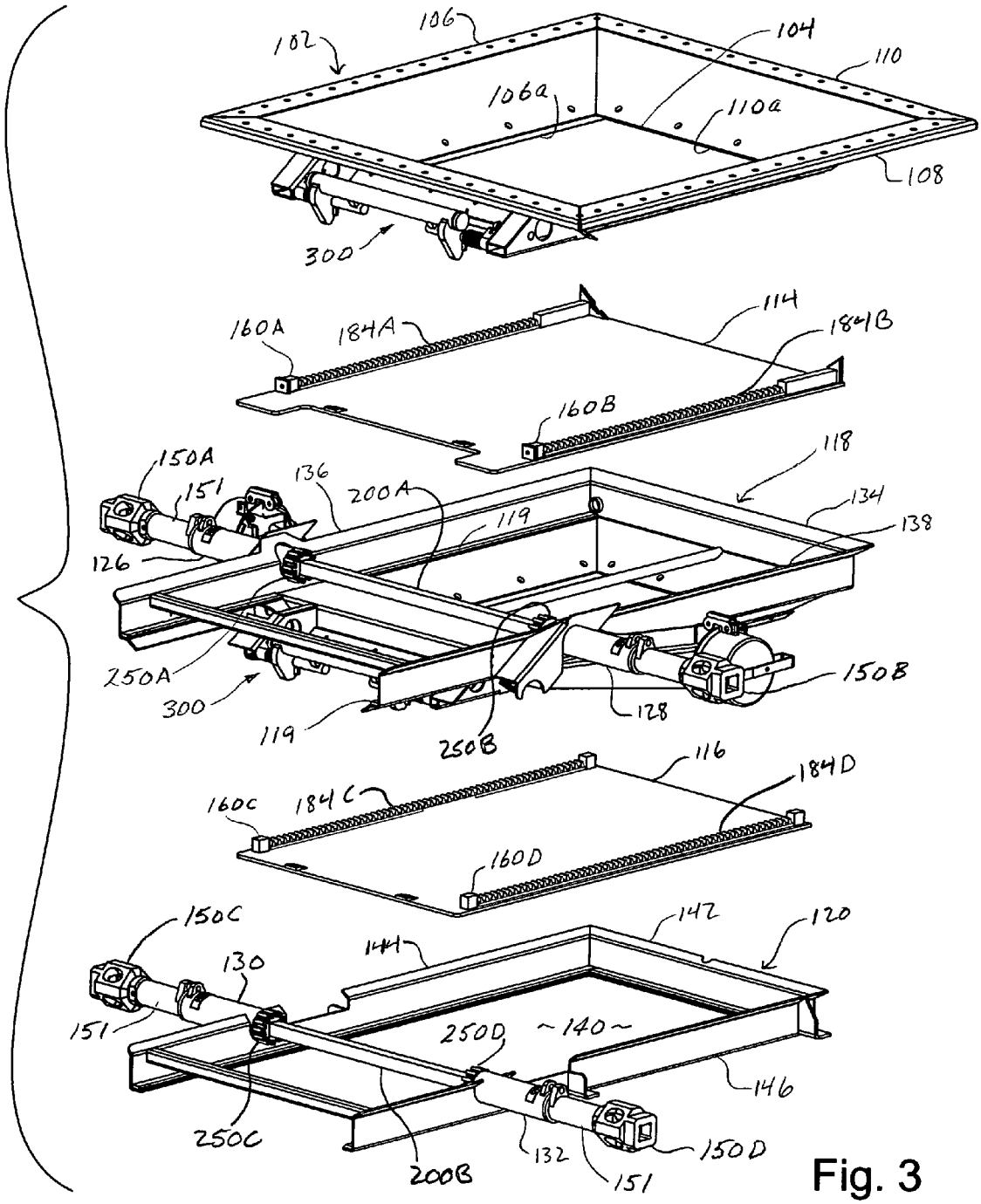
FIG. 3 is a partial, exploded view of the discharge gate.

Referring now to the drawings, and initially in particular to FIGS. 1–3, wherein like reference numerals indicate like parts throughout the several views, a railroad hopper car discharge gate 100 is illustrated for the purpose of describing an embodiment of the drive system of the present invention. The discharge gate 100 includes a generally rectangular upper frame or hopper 102 surrounding a generally rectangular, central discharge opening 104 (see FIG. 3). The upper frame 102 includes four upper sidewalls 106, 108, 110 and 112. Each of the sidewalls 106, 108, 110, and 112 has a lower, inner edge that, in combination, define the discharge opening 104 (lower edges 106*a*, 108*a* and 110*a* are visible in FIGS. 1–3). The discharge gate 100 is provided with an upper door panel 114 and a lower door panel 116 that slide fore and aft between open and closed positions within respective middle 118 and lower 120 frames. Upper panel 114 is shown partially open; lower panel 116 is shown fully open. A pair of opposed vacuum nozzles 122 and 124 are mounted on the frames 118, 120 so as to open into a chamber below the discharge opening 104. Transversely extending upper bearing tubes 126 and 128 and lower bearing tubes 130 and 132 project from the middle frame 118 and lower frame 120, respectively.

The upper bearing tubes 126 and 128 house outer portions of an upper drive shaft 200A (FIG. 3). Lower bearing tubes 130 and 132 house the outer portions of a lower drive shaft 200B. Door panels 114 and 116 are moved between open and closed positions when the drive shafts 200A and 200B, respectively, are rotated in the appropriate directions. Pinion gears (pinions) 250 driven by the drive shafts 200 engage racks 184 attached to the panels 114 and 116 to provide a rack and pinion drive system. (Like components are referred to herein in general by number, e.g., pinions 250 and drive shafts 200, and by specific instance by addition of lettering, e.g., pinions 250A and 250B associated with upper drive shaft 200A.)

FIG. 3 is an exploded view of the gate 100 with major components separated from one another for clarity. The middle frame 118 is secured to the underside of the upper frame 102 and comprises sidewalls 134, 136, and 138. The upper panel 114 slides within the middle frame 118 and is typically supported principally by sidewalls 136 and 138 or by support components associated with sidewalls 136 and 138. The walls of the middle frame define a lower discharge opening 140.

The lower frame is 120 is secured to the underside of the middle frame 118 and comprises sidewalls 142, 144, and 146. The lower panel 116 slides within the lower frame 120 and is typically supported principally by sidewalls 144 and 146 or by components associated with sidewalls 144 and 146. The lower discharge opening 140 may be sealed shut by positioning lower panel 116 in a closed position.

Figure 4:
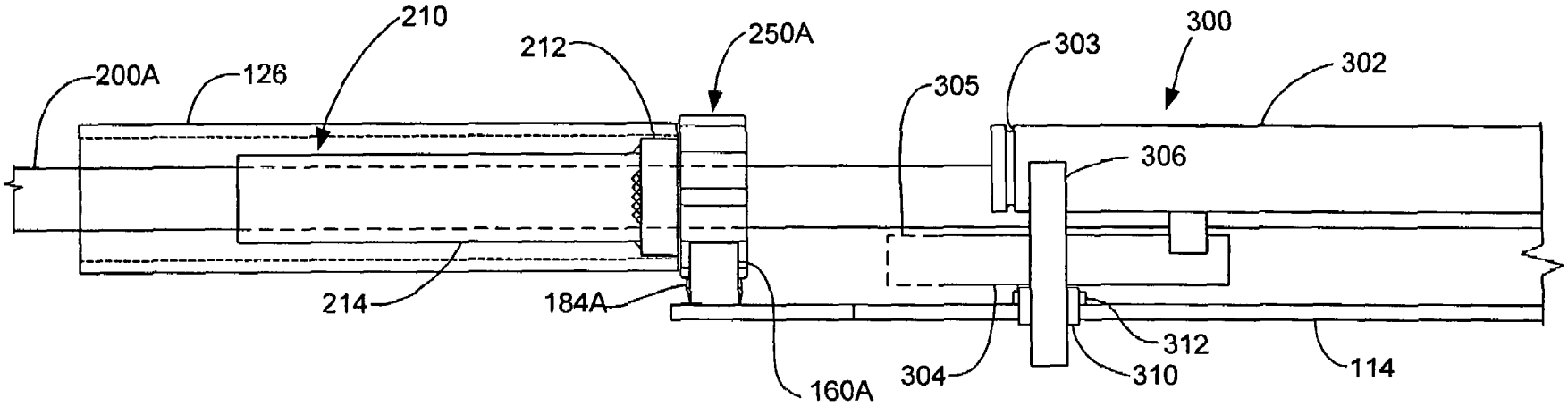
FIG. 4 is a partial front view of selected components of the drive system, and shows the inertia brake in its actuated position.
Figure 5:
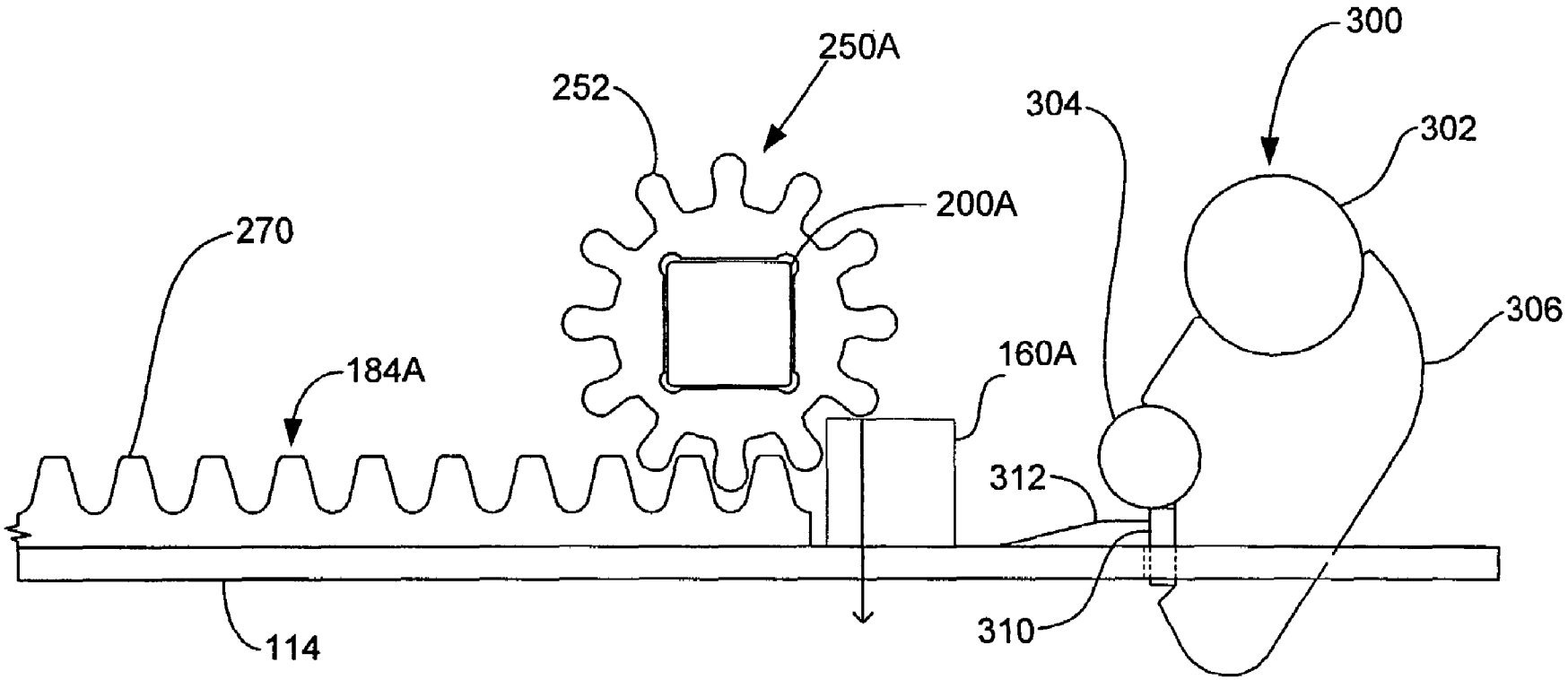
FIG. 5 is a partial side view of selected components of the drive system seen in FIG. 4, and shows the inertia brake in its actuated position.

FIG. 4 is a partial front view of selected components of the drive system responsive to the horizontally disposed upper drive shaft 200A. Reference may also be made to FIG. 5 which provides a partial side view of selected components of the drive system, omitting the bearing tube 126 and bearing spacer 210 of FIG. 4. The upper door panel 114 underlies the drive shaft 200A, the view in FIG. 4 showing the front end of the door panel 114. The pinion 250A is mounted on the drive shaft 200A so as to overlie the door panel 114, and more particularly, to overlie the rack 184A attached to the upper surface of the door panel 114. A stop block 160A caps the front end of the rack 184A, its purpose being to limit rearward travel of the door panel 114 as illustrated in FIG. 5, together with stop block 160B at the front end of rack 184B. Similarly, stop blocks 160C and 160D are provided on door panel 116 at the front ends of racks 184C and 184D as shown in FIG. 3. As is shown in the exploded view of FIG. 3, stop blocks are also positioned at the rear ends of the racks 184 to limit forward travel.

As shown in FIG. 4, the bearing spacer 210 is mounted on the drive shaft 200A outward of the pinion 250A. The coaxial bearing tube 126 encloses the bearing spacer 210. The bearing tube 126 is attached to the middle frame 118 and is aligned with the opposing bearing tube 128 which is also attached to the middle frame 118, see FIGS. 1–3. The upper drive shaft 200A (FIG. 4) extends coaxially through bearing tube 126 (and through bearing tube 128, not shown in FIG. 4) and is supported within each tube by a bearing 212 at the inner end of an associated spacer tube 214 in each of the bearing tubes 126 and 128.

Figure 13:
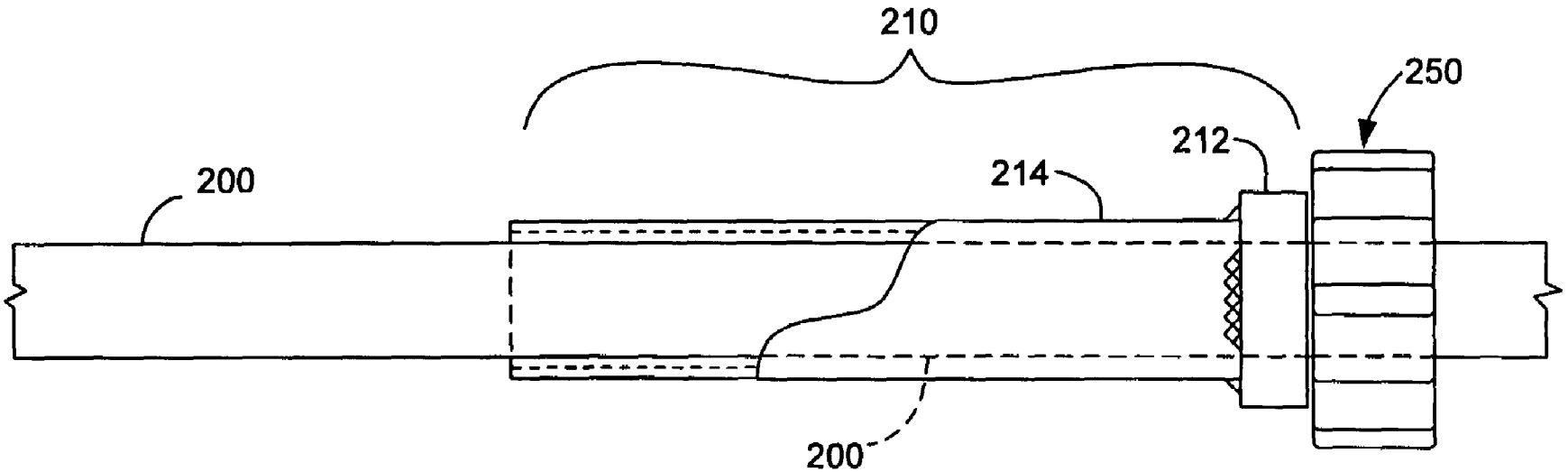
FIG. 13 is a partial, front elevational view of a drive shaft engaged with a pinion and associated bearing spacer.
Figure 14:
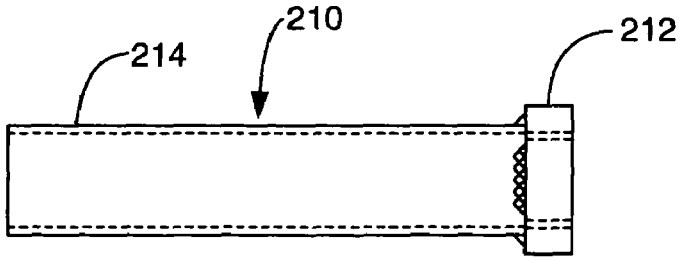
FIG. 14 is an elevational view of the bearing spacer seen in FIG. 13, on a reduced scale.
Figure 15:
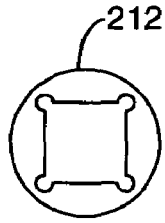
FIG. 15 is an end view of the bearing of FIG. 14.
Figure 16:
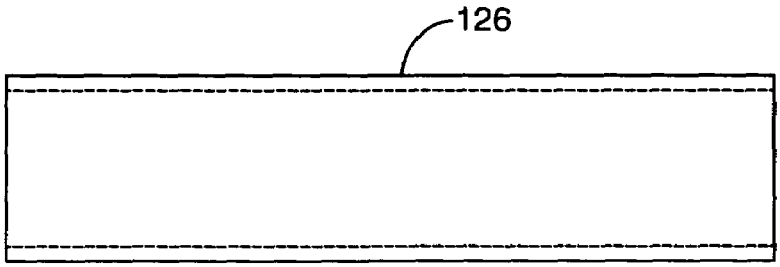
FIG. 16 is a detail of the bearing tube.
Figure 17:
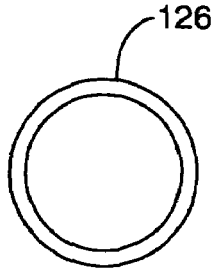
FIG. 17 is an end view of the bearing tube of FIG. 16.

FIGS. 13–17 show in detail the components of the drive system that minimize deflection of each of the drive shafts 200A and 200B. FIG. 13 is a partial, front elevational view of representative drive shaft 200 extending through pinion 250 and bearing spacer 210. (The pinion 250 engages an associated rack 184, see FIGS. 4 and 5.) Bearing spacer 210 is telescoped over the drive shaft 200 to the position shown so that the bearing portion 212 of the bearing spacer 210 abuts the pinion 250. The bearing 212 may be steel, bronze, aluminum, plastic or other bearing material (see FIG. 15 for an end view) and is sized to a diameter to fit coaxially inside the associated bearing tube (such as tube 126, see FIGS. 4, 16 and 17), allowing sufficient clearance for the bearing spacer 210 to easily rotate inside the bearing tube. As configured in this embodiment, the weight of the drive shafts 200A and 200B and pinions 250A–D is therefore supported by the bearings 212 in contact with the inner surfaces of the respective bearing tubes 126–132.

Each bearing spacer 210 may be formed by welding the bearing 212, having a substantially square, hollow interior sized to accept the drive shaft 200, to the inner end of spacer tube 214, which likewise has a transversely square configuration. Alternatively, tube 214 and bearing 212 may be separate components. A socket (see 150A, 150B, 150C and 150D, FIGS. 1–3) or other means of inducing shaft rotation is mounted on the outer end of each drive shaft 200. Each socket 150 includes an extension 151 which abuts the outer end of the associated bearing spacer 210 thereby retaining the bearing spacer 210 between the socket 150 and pinion 250. (The socket to drive shaft coupling is set forth in greater detail below with reference to FIG. 18.) Upon rotation, the bearing 212 distributes any transverse deflection or load of the drive shaft 200 and pinions 250 to the bearing tube 126 (see FIG. 4), and also centers the drive shaft 200 within the bearing tube 126. The spacer tube 214 also supports the drive shaft 200 and substantially reduces drive shaft deflection from its rotational axis when placed under axial or rotational load.

As illustrated in FIG. 5 with respect to upper door panel 114, pinion 250A is an external spur gear that meshes with rack 184A on the upper door panel 114. In the double-door gate 100, the door panels 114, 116 underlie the pinions 250. At the rearward limit of the drive (FIG. 5), the stop block 160A (and 160B) acts to prevent further travel of the door 114 to the left without damaging the drive system components. (The same occurs with respect to stop blocks 160C and 160D on door 116.) Each of the stop blocks is specially sized and positioned (synchronized) so as to convert torque from the associated pinion 250, from normally horizontal in rack 184 to vertical in the synchronized stop block. For example, referring to FIG. 5, the vertical force applied to the door panel 114 by clockwise rotation of pinion 250A through the door stop 160A is illustrated by the arrow. In an overdrive door where the pinions are over the door panel, a vertical counterforce is provided by the guides under the edges of the panel, such as shown in FIG. 3 by glide strips 119 on middle frame 118 underlying panel 114. In an underdrive door where the pinions are beneath the door panel, opposition to the vertical force applied by the pinions is provided by a pair of opposed anti-lift pegs 501 (FIGS. 18, 19 and 22) projecting inwardly from the sides of the gate frame in the single-door discharge gate described below. Each of the anti-lift pegs 501 is a heavy rigid peg welded to the side of the gate frame and positioned vertically close to the top of the door panel (about 0.090 inch clearance, for example), and projecting parallel to the axis of the underlying pinion.

Single-Door Discharge Gate

A single-door, railroad car discharge gate 500 is shown in FIGS. 19–22 and includes a generally rectangular upper frame or hopper 502 surrounding a generally rectangular discharge opening 504. The upper frame 502 includes four upper sidewalls 506, 508, 510 and 512. The discharge gate 500 has a door panel 514 that slides between open and closed positions within the frame 520. Panel 514 is shown partially open.

The frame 520 includes elongated sides 520A and 520B. The door panel 514 is supported primarily by underlying rails 552A, 552B and 552C. Transversely extending bearing tubes 526 and 528 project outwardly from the frame 520. Bearing tubes 526 and 528 house outer portions of a drive shaft 600. The door panel 514 is moved between open and closed positions when the drive shaft 600 is rotated in the appropriate directions. Pinion gears (pinions) 650A and 650B (identical to pinions 250A–D) are driven by the drive shaft 600 and engage racks 584A and 584B, which are attached to the underside of panel 514 to provide a rack and pinion drive system (in contrast to the overdrive system for the double-door gate). The drive shaft 600 may be rotated by applying rotational force to either of a pair of sockets 550 located at opposite ends of the drive shaft 600. Stop blocks 560A and 560B are attached to a forward portion of the underside of the door panel 514 and assist in stopping the door panel 514 in a predetermined position when the door panel 514 is moving to a closed position. Stop blocks 560C and 560D are attached to a rearward portion of the underside of the door panel 514 and are engaged by the associated pinions 650A and 650B at the end of door travel as described previously with respect to the double-door discharge gate.

Figure 18:
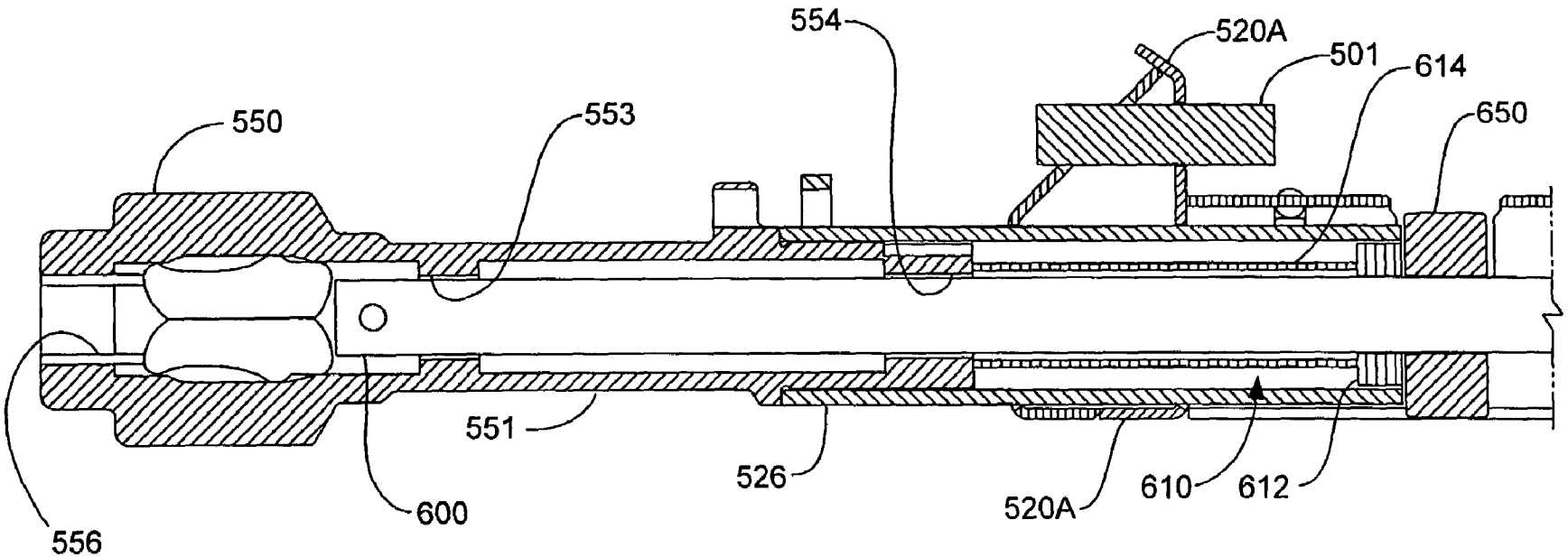
FIG. 18 is a section of a bearing tube and associated structures including a bearing, bearing spacer and socket mounted on a drive shaft.

FIG. 18 illustrates bearing tube 526 in partial cross section and associated structures including a bearing spacer 610 and associated socket 550 mounted on one end of drive shaft 600. (The drive shaft 600 is not shown in section.) The bearing spacer 610 is slidably mounted on the drive shaft 600 between the socket 550 and the pinion 650. More specifically, socket 550 includes an integral, coaxial shank 551 which is received within the outer end of bearing tube 526 and abuts the outer end of a spacer tube 614, and engages the flats of drive shaft 600 via radially inwardly projecting collars 553 and 554, each of which defines a square opening receiving drive shaft 600. The bearing spacer 610 thus supports the drive shaft 600 and substantially prevents shaft deflection under rotational load. As shown in FIG. 18, the bearing spacer 610 may be formed as one piece by joining a spacer tube 614 with a bearing 612 at its inner end, or may comprise a separate component adjacent to the bearing 612. In either embodiment the bearing spacer 610 functions to hold the bearing 612 adjacent to the inner end of the bearing tube 526, typically adjacent the pinion 650.

Figure 22:
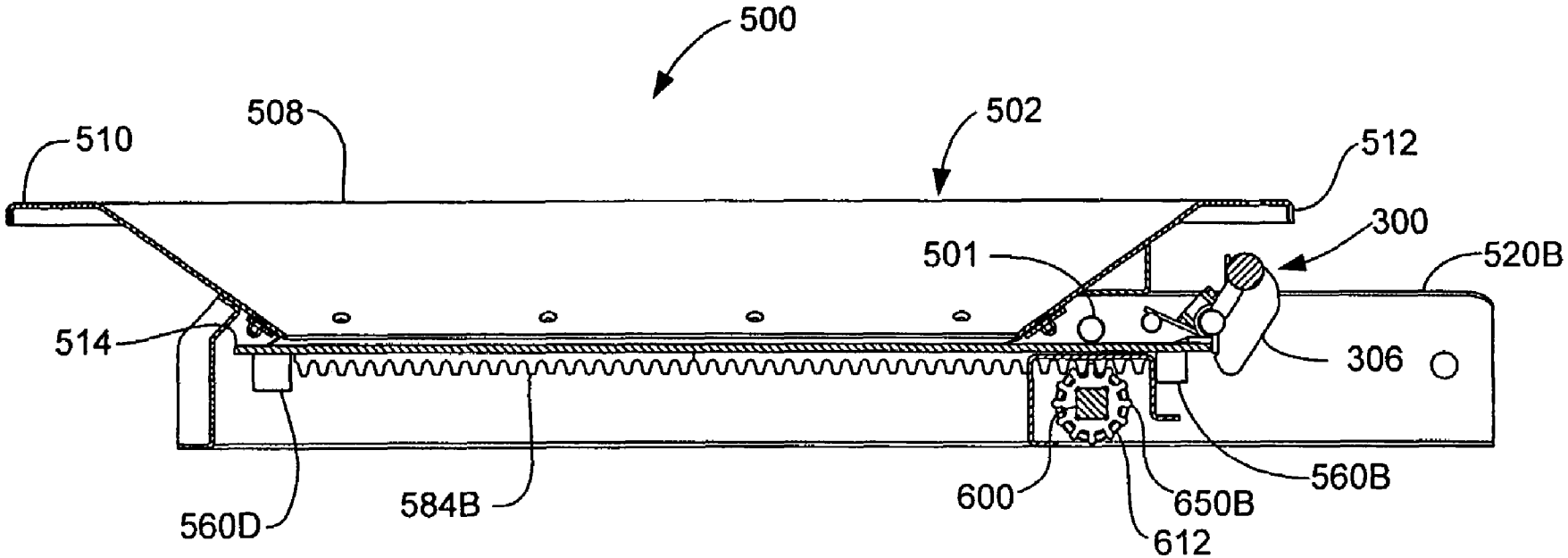
FIG. 22 is a partial longitudinal section of the discharge gate of FIG. 19 taken along line 22—22 of FIG. 19, the panel being shown in a retracted state.

FIG. 22 is a partial, longitudinal section of the discharge gate 500 with the panel 514 shown in a retracted or closed position. As illustrated, the panel 514 is located below the hopper 502 and is driven between open and closed positions by rack 584B and pinion 650B. The panel 514 is shown in a closed position and an inertia brake 300 (described below) is shown engaged with the leading edge of the panel 514. It may be appreciated that when drive shaft 600 is rotated clockwise, the pinion 650B is caused to rotate clockwise as well driving the rack 584B rightwards, thereby sliding the panel 514 to an open position.

Pinion Drive

Figure 6:
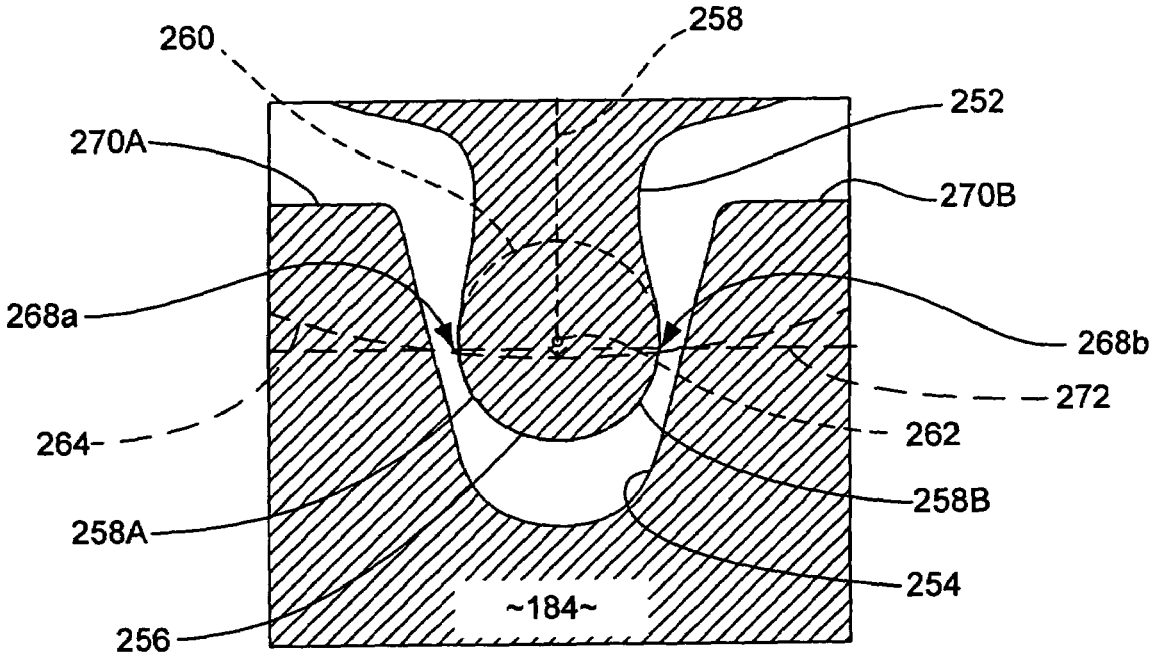
FIG. 6 is a diagrammatic, partial section of a pinion meshed with a rack showing a pinion tooth disposed in the space between two rack teeth.

The pinion teeth 252 of the drive systems for the discharge gates present generally cylindrical profiles in a plane orthogonal to the axis of pinion rotation. FIG. 6 is a partial section of pinion 250 meshed with rack 184 illustrating a downwardly projecting pinion tooth 252 disposed in a space 254 between two rack teeth 270A and 270B. The pinion tooth 252, as illustrated, has a tip 256 or top land as well as working surfaces or sides 258A and 258B that are substantially circular in profile such that the profile of the tip 256 and sides 258 of the tooth 252 is that of a cylinder when continued along imaginary line 260. Imaginary point 262 indicates the center point of the cylinder. The pitch circle 264 is an ideal, imaginary circle, concentric to the axis of the pinion 250, that intersects pitch points 268*a* and 268*b*. The pitch radius (indicated by broken line 258) is the distance from the axis of the pinion 250 to the pitch circle 264. Ideally, the pitch points 268*a* and 268*b* and pitch radius 258 remain constant during operation of the rack 184 and pinion 250.

Pitch line 272 is an ideal, imaginary line, parallel to the longitudinal axis of the rack 184. When the pitch of the pinion 250 and the pitch of the rack 184 are matched such that the pitch points 268 of the pinion teeth 252 contact the faces of the rack teeth 270 along the pitch line 272, the two lines 264 and 272 exhibit conjugacy, a common velocity as if a cylinder were in rolling contact with a flat surface. If conjugacy can be maintained, efficiency of power transfer from the pinion 250 to the rack 184 is maximized and adverse phenomena such as skipping or climbing are avoided.

Figure 8:
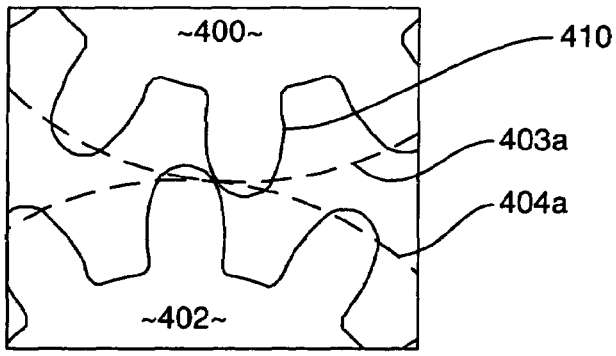
Fig. 8 (Prior Art)
FIG. 8 (prior art) is a diagram illustrating a first point of contact between teeth on meshed gears.
Figure 9:
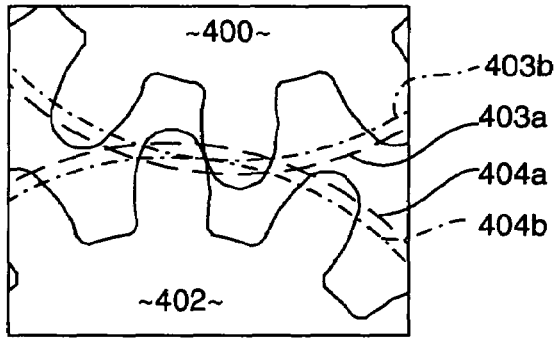
Fig. 9 (Prior Art)
FIG. 9 (prior art) is a diagram illustrating a second point of contact between teeth on gears meshed at a closer distance to one another.
Figure 10:
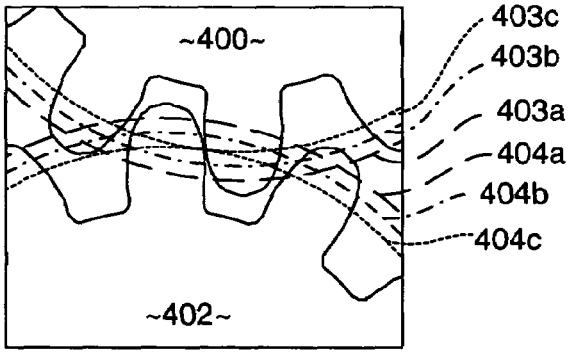
Fig. 10 (Prior Art)
FIG. 10 (prior art) is a diagram illustrating a third point of contact between teeth on gears meshed at yet a closer distance to one another.
Figure 11:
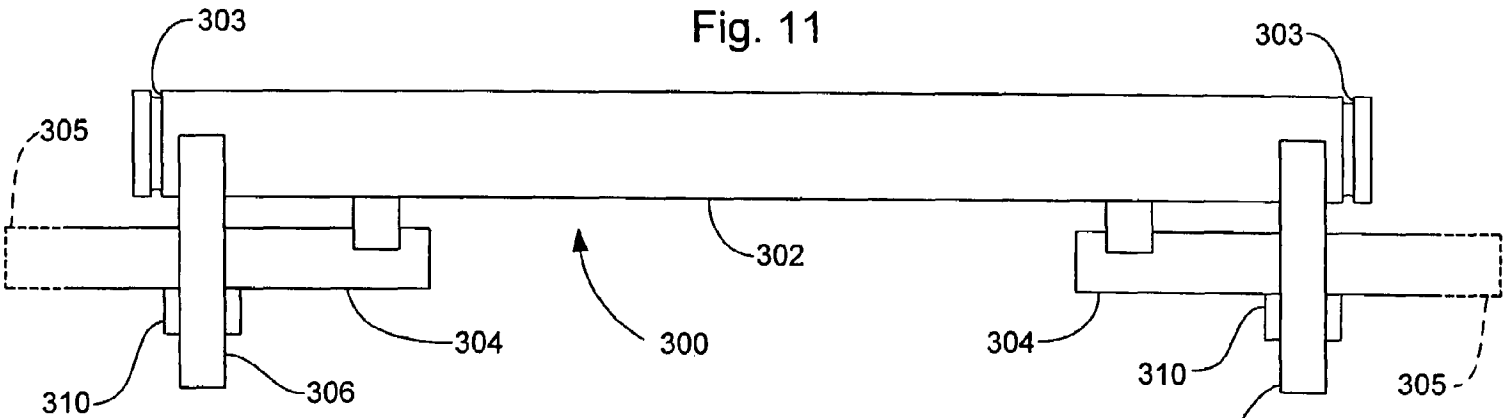
FIG. 11 is a front elevational view of the inertia brake in its actuated position.

In the prior art, it is known to use teeth with crowned profiles, such as involute curves, when meshing circular, external spur gears 400 and 402, see FIGS. 8 through 10. In FIG. 8 two spur gears 400 and 402 are shown in rolling contact, their pitch points coinciding at the intersection of pitch circles 403*a* and 404*a*. If the gears 400 and 402 are drawn together, see FIG. 9, the diameters of the respective pitch circles decrease as shown by circles 403*b* and 404*b*. Due to the crowned profiles, however, the change in diameters is concomitant and conjugacy tends to be maintained. This is further illustrated in FIG. 10 in which the gears 400 and 402 are drawn still further together, yet conjugacy is maintained along pitch circles 403*c* and 404*c*.

Figure 23:
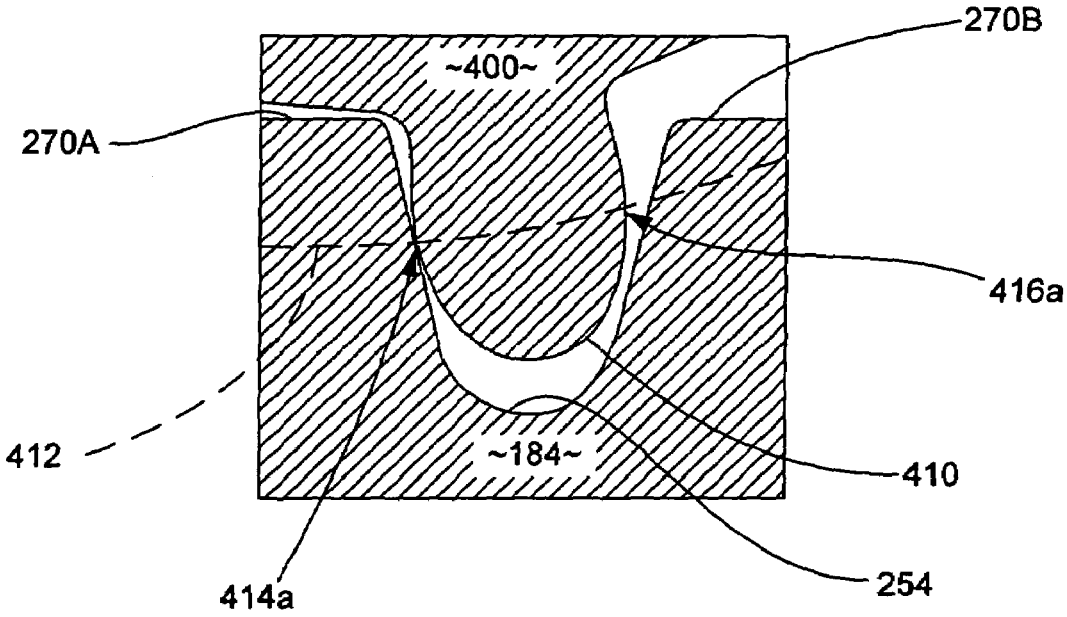
Fig. 23 (Prior Art)
FIG. 23 (prior art) is a diagrammatic, partial section of a prior art spur gear meshed with a rack.
Figure 24:
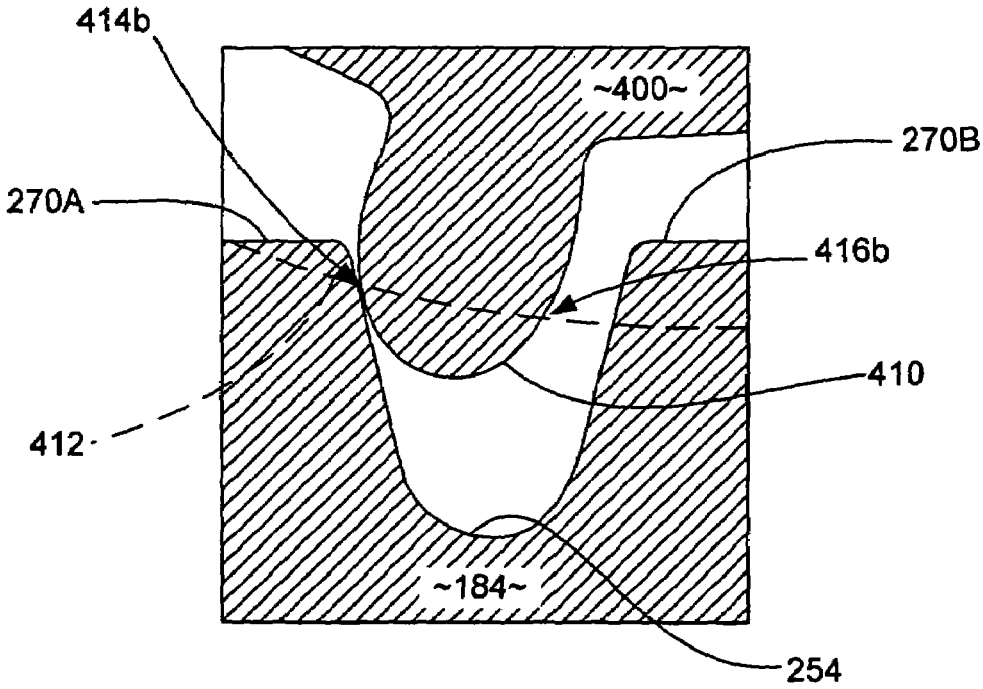
Fig. 24 (Prior Art)
FIG. 24 (prior art) is a diagrammatic, partial section illustrating loss of conjugacy when the prior art gear tooth of FIG. 23 is disposed at an increased distance from the rack.

However, when one of such gears 400 or 402 is mated with a rack having a linear pitch line, conjugacy is not maintained as the distance between the gear and the rack fluctuate. FIG. 23 is a partial sections of a gear 400 meshed with rack 184 illustrating a gear tooth 410 with an elliptical profile disposed in the space 254 between the two rack teeth 270A and 270B. The pitch circle 412 is an ideal, imaginary circle, concentric to the axis of the rear 400, that intersects pitch points 414*a* and 416*a*. In FIG. 24, the gear 400 has moved away from the rack 184 as may occur if the surface upon which the rack 184 is mounted deflects downward. As shown, the pitch points 414*b* and 416*b* are nearer to the tip of the tooth 410 and the pitch circle 412 has increased in diameter, thereby indicating a change in pitch. Because the pitch of the rack 184 is constant, the conjugacy between the gear 400 and rack 184 is lost and skipping may occur.

Figure 7:
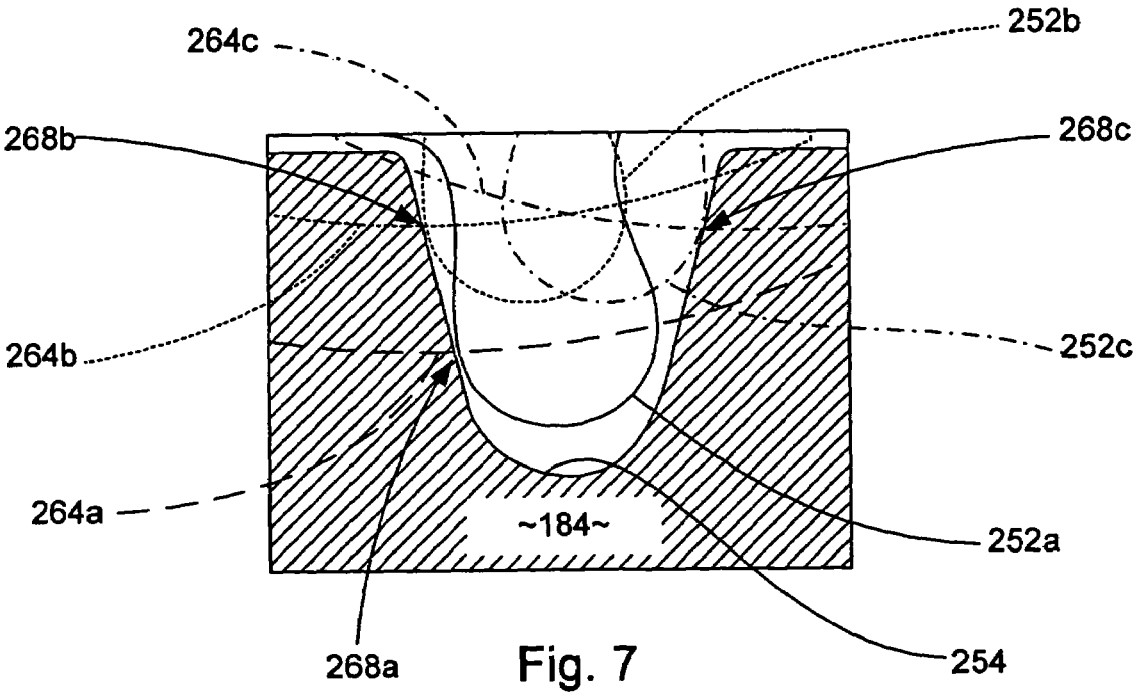
FIG. 7 is a diagrammatic, partial section illustrating pitch point continuity when a pinion tooth is engaged, at various distances, from a rack.

FIG. 7 is partial section illustrating pitch point continuity when one of the pinion teeth 252 of the present invention is engaged at various distances from rack 184. The lowest (deep) pitch point is designated 268*a*, and two higher (shallow) pitch points are designated 268*b* and 268*c*. Due to the circular working surface of the tooth 252*a*, the pitch of the pinion does not change as the distance between the rack and pinion change. Although absolute conjugacy may not be maintained as these distances vary, the relative constancy of the pitch points 268*a*, 268*b* and 268*c* and pitch radius 258 (FIG. 6) reduces the tendency of the pinion teeth 252 to climb or skip.

Inertia Brake

Figure 19:
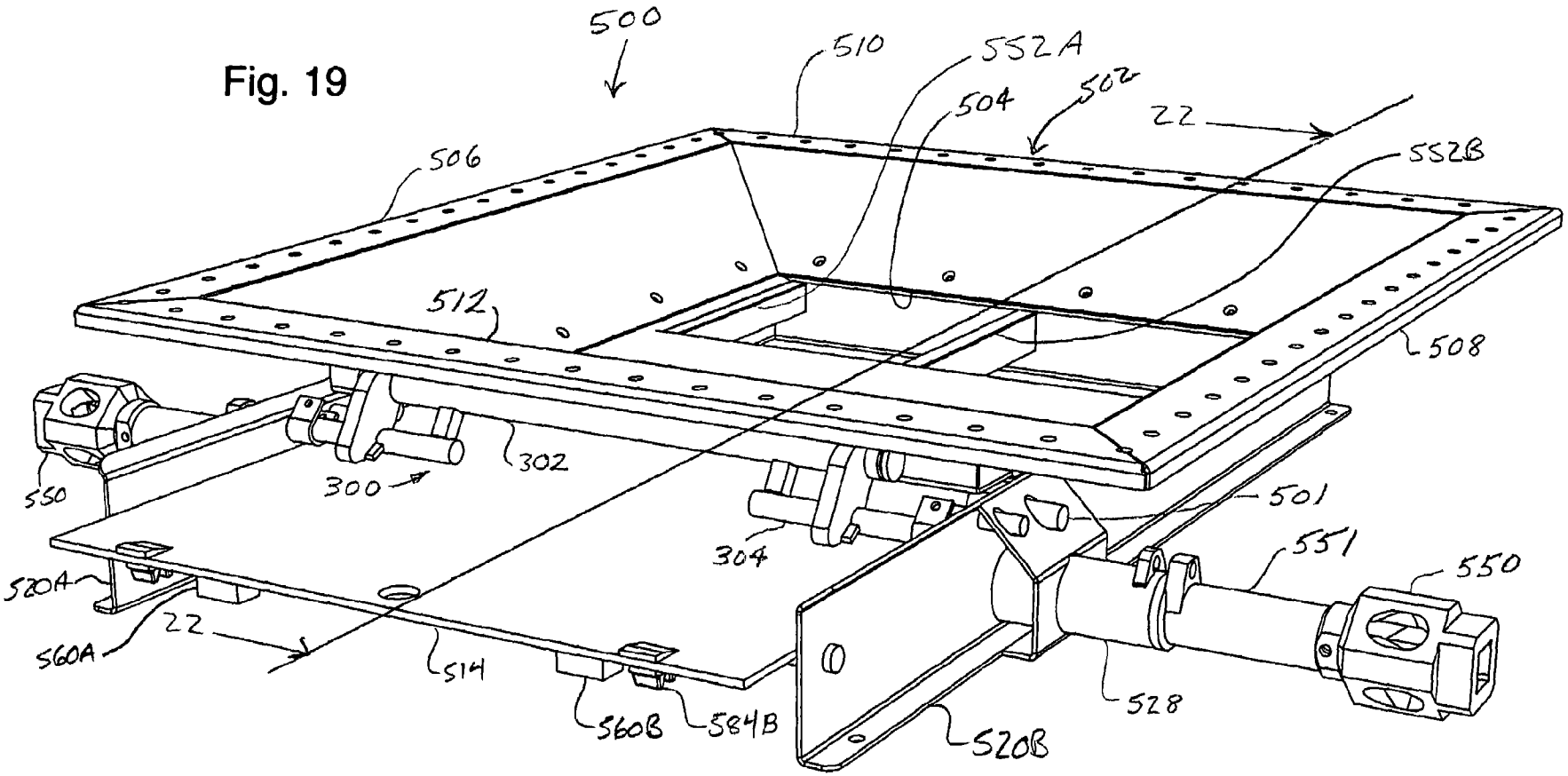
FIG. 19 is a frontal and side perspective view of a single-door, railroad car discharge gate in accordance with another embodiment of the present invention.
Figure 20:
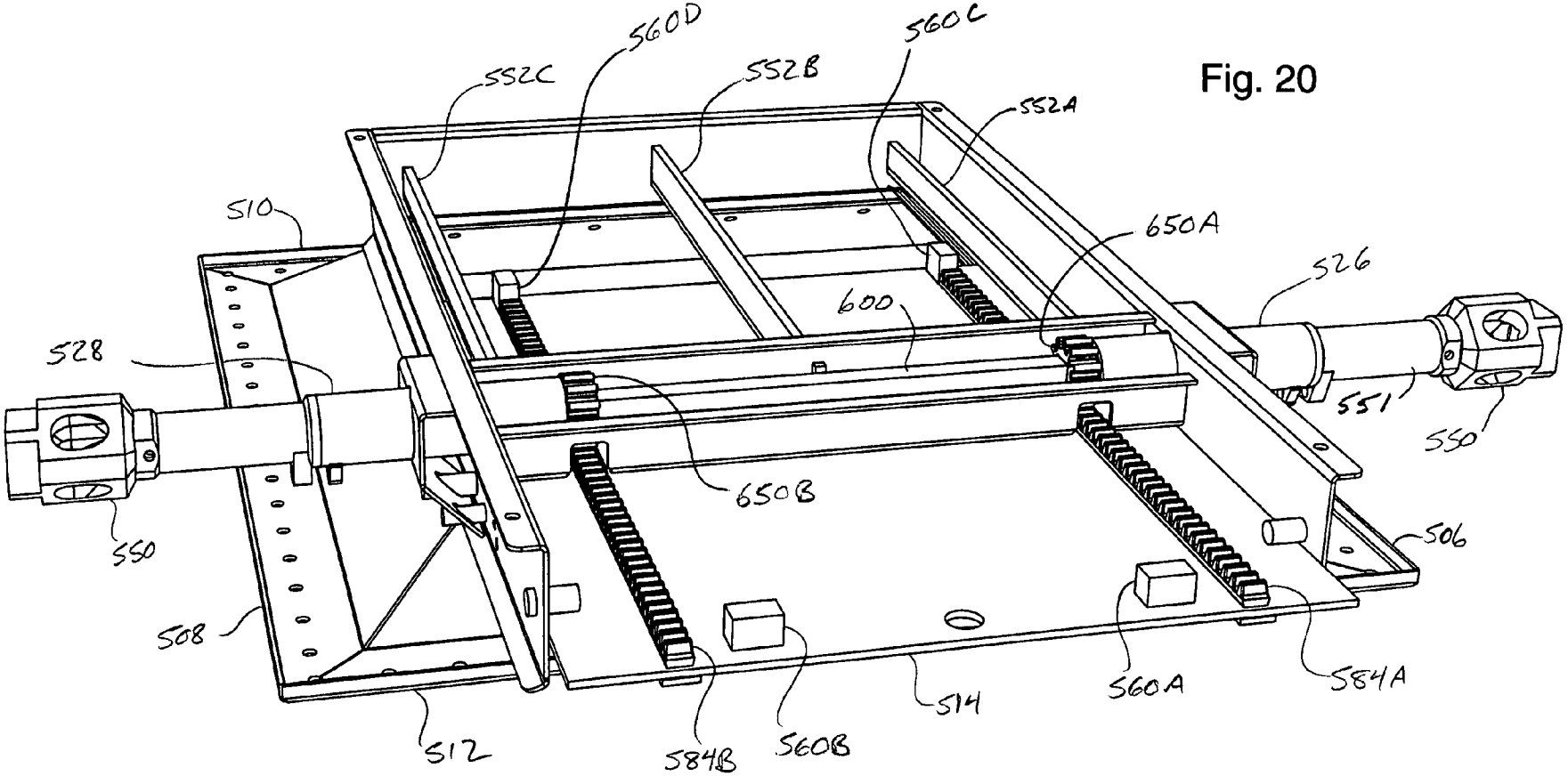
FIG. 20 is a bottom perspective view of the discharge gate of FIG. 19.
Figure 21:
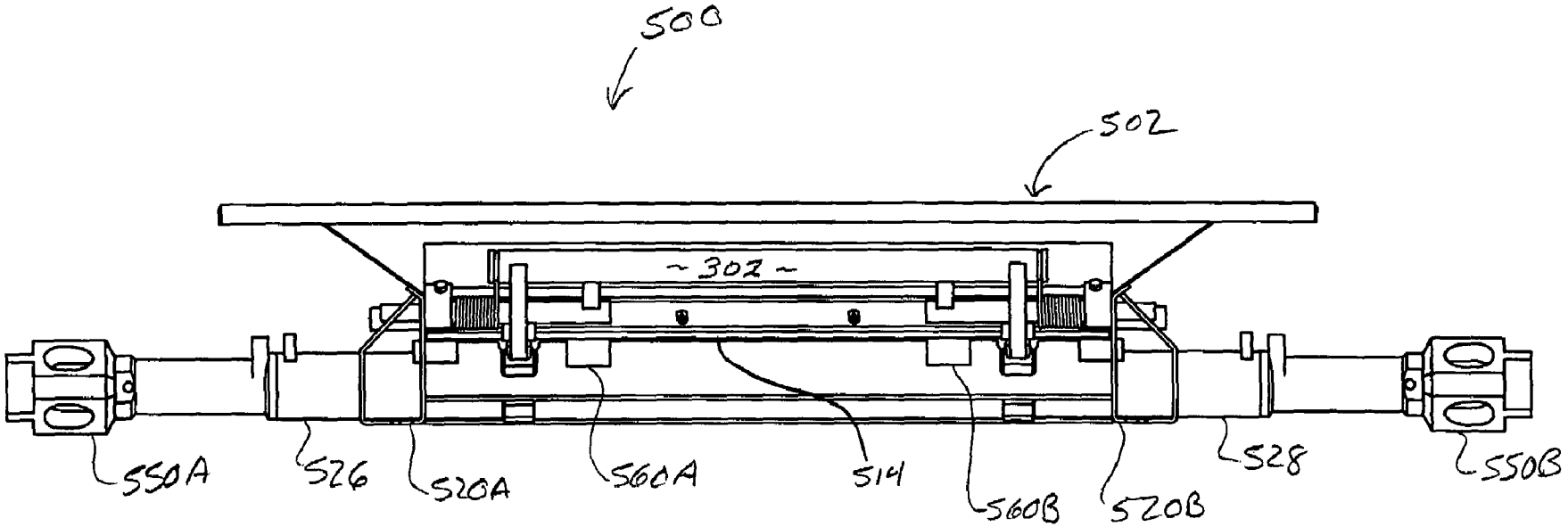
FIG. 21 is a front elevation of the discharge gate of FIG. 19.

An inertia brake 300 for each door panel of the discharge gate 100 is shown particularly in FIGS. 4, 5, 11 and 12. The inertia brake 300 includes a counterweight 302 (illustrated herein as horizontal, transverse cylindrical bar) mounted to upper frame 102 associated with door panel 114 via pivoting means such as a pair of axially aligned pivot shafts 304. Transverse disposition of the inertia brake 300 across the upper frame 102 is shown in FIGS. 1–3 (and is also shown in FIG. 19 on frame 502 of the single-door gate). In FIG. 4, the outer end portion of one of the pivot shafts 304 is indicated in phantom lines 305. This end portion 305 of the pivot shaft 304 is rotatably supported by the frame or associated structures during operation of the inertia brake 300. The counterweight 302 is supported in a spaced position from the pivot rods 304 by a pair of arms 306 extending radially from corresponding pivot shafts 304. In the embodiment illustrated, each arm 306 is notched in an upper, rearward portion to accept the weight bar 302 and in a middle, rearward portion to receive the pivot rod 304. A lower, rearward notch is provided with a strike plate 310 that is aligned to meet and engage a corresponding plate 312 located on the upper surface of the door panel 114. The plates 310 and 312 enhance the strength and durability of the apparatus but it should be appreciated that they are not necessary for the inertia brake 300 to be operative. As shown in FIGS. 1 and 2, a pair of strike plates 312 are located near the leading edge of each door panel 114, 116.

Figure 12:
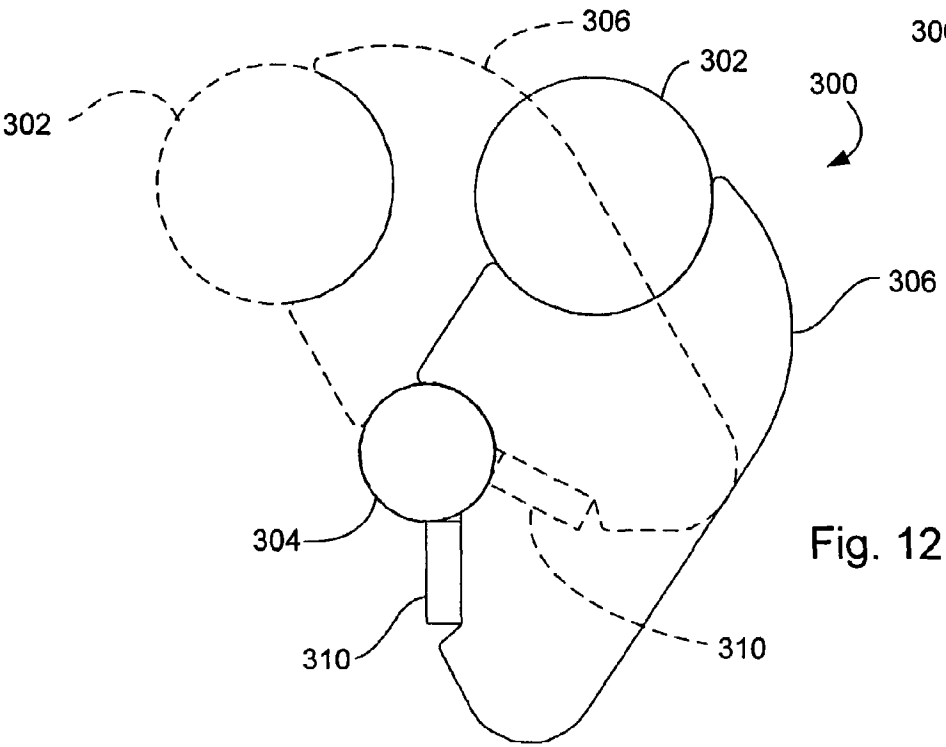
FIG. 12 is a fragmentary, enlarged, side elevational view of the inertia brake of FIG. 11.

In use, the arms 306 of each inertia brake 300 are held in a braking position (see full lines, FIG. 12) by biasing means such as a pair of springs 308, each of which is on a respective pivot shaft 304 and acts against the arm 306. The bar 302 includes an annular notch 303 at each end thereof (see FIG. 4) for receiving and retaining one arm of the associated spring 308, the other arm thereof being anchored to a post or other structure associated with the frame of the apparatus (see FIG. 2). The springs 308 should be selected, and secured to the inertia brake 300 and frame, to apply sufficient tension to keep the inertia brake 300 in the braking position during normal use such as when the associated railway hopper car is stationary or in normal transit. Referring to FIGS. 5 and 12, when the discharge gate 100 or 500 is subjected to a rapid halt, such as when the hopper car impacts another railway car, inertial action upon the bar 302 causes it to apply additional holding force against the associated door panel 114, 116 or 514 and pivot further in a clockwise direction if necessary to close any space that may exist between the strike plates 310 and 312. This positively restrains the panel against movement and prevents an unintended opening of the discharge gate. In normal opening and closing operation, the springs 308 yield as the panel advances to the open position as illustrated by the broken line, released position of the brake components shown in FIG. 12. When the panel is subsequently closed, it is withdrawn to the position shown in FIG. 5 and the springs 308 return the brake to the normal, braking position shown in full lines in FIGS. 5, 12 and 22.

It is to be understood that while certain forms of this invention have been illustrated and described, it is not limited thereto except insofar as such limitations are included in the following claims and equivalents thereof.

The invention claimed is:

1. A drive system in combination with a railroad car discharge gate, comprising:

a hopper frame defining a discharge opening, a door panel movable along a fore and aft path across said opening and between an open position and a closed position, a rack attached to said door panel and extending along said path, said rack presenting multiple rack teeth, a drive shaft associated with said hopper frame, extending transversely of said path, and having an outer end adapted to be coupled with an operating device, a gear mounted on said shaft for rotation thereby and having a plurality of gear teeth successively engageable with said rack teeth, an elongated, tubular spacer receiving said shaft between said gear and said outer end for supporting said shaft against deflection under rotational load, said spacer having an inner end adjacent said gear and being provided with structure at said inner end restraining said spacer against radial movement, and a bearing tube generally coaxial with said spacer and fixed to said hopper frame.

2. The drive system of claim 1, wherein said structure comprises a bearing engageable with said tube.

3. The drive system of claim 1, wherein each of said gear teeth presents a substantially semicircular working surface, said rack having teeth of constant pitch.

4. The drive system of claim 1, wherein each of said gear teeth presents a substantially cylindrical profile in a plane orthogonal to an axis of gear rotation.

5. The drive system of claim 1, wherein said door panel is generally horizontal, said system further comprising an inertia brake for holding said door panel against forward movement, said brake including a counterweight above said door panel having a braking position and a released position, an arm mounting said counterweight for movement between said braking position and said released position in response to normal opening of said door panel, and structure on said arm for engaging and holding said door panel when the counterweight is in its braking position and responds to a forward force indicative of a rapid halt of the car.

6. A drive system in combination with a railroad car discharge gate, comprising:

a hopper frame defining a central opening, a generally horizontal door panel movable alone a fore and aft path across said opening and between an open position and a closed position, a rack attached to said door panel and extending along said path, said rack presenting multiple rack teeth of constant pitch, a drive shaft associated with said hopper frame, extending transversely of said path, and having an outer end adapted to be coupled with an operating device, a gear mounted on said shaft and having a plurality of gear teeth in meshed engagement with said rack, each of said gear teeth presenting a cylindrical profile in a plane orthogonal to an axis of rotation of said gear, and an inertia brake for holding said door panel against forward movement, said brake including a counterweight above said door panel having a braking position and a released position, an arm mounting said counterweight for movement between said braking position and said released position in response to normal opening of said door panel, and structure on said arm for engaging and holding said door panel when the counterweight is in its braking position and responds to a forward force indicative of a rapid halt of the car.

7. A chive system in combination with a railroad car discharge gate, comprising:

a hopper frame defining a central opening, a generally horizontal door panel movable along a fore and aft path across said opening and between an open position and a closed position, a rack attached to said door panel and extending along said path, said rack presenting multiple rack teeth, a drive shaft associated with said hopper frame, extending transversely of said path, and having an outer end adapted to be coupled with an operating device, a gear mounted on said shaft for rotation thereby and having a plurality of gear teeth successively engageable with said rack teeth, and an inertia brake for holding said door panel against forward movement, said brake including a counterweight above said door panel having a braking system and a released position, an arm mounting said counterweight for movement between said braking position and said released position in response to normal opening of said door panel, and structure on said arm for engaging and holding said door panel when the counterweight is in its braking position and responds to a forward force indicative of a rapid halt of the car.

8. The drive system of claim 7, wherein said structure includes a strike element for engaging a leading edge of said door panel.

9. The drive system of claim 7, wherein said inertia brake further includes a yieldable component biasing said arm to return the counterweight to its braking position after said panel is opened and closed.

10. A drive system in combination with a railroad car discharge gate, comprising:

a hopper frame defining a central opening, a generally horizontal door panel movable along a fore and aft path across said opening and between an open position and a closed position, a rack attached to said door panel and extending along said path, said rack presenting multiple rack teeth terminating at an end of the rack, a drive shaft associated with said hopper frame, extending transversely of said path, and having an outer end adapted to be coupled with an operating device, a gear mounted on said shaft for rotation thereby and having a plurality of gear teeth successively engageable with said rack teeth, a stop on said panel adjacent said end of the rack, engageable by said gear and cooperating therewith to convert torque applied to said stop by said gear to a generally vertical force applied to said panel, and structure engageable with said panel for providing a counterforce in response to said applied force.

11. The drive system of claim 10, wherein each of said gear teeth presents a cylindrical profile in a plane orthogonal to an axis of rotation of said gear.

12. A drive system in combination with a railroad car discharge gate, comprising:

a hopper frame defining a central opening, a generally horizontal door panel movable along a fore and aft path across said opening and between an open position and a closed position, a rack attached to said door panel and extending along said path, said rack presenting multiple rack teeth terminating at an end of the rack, a drive shaft associated with said hopper frame, extending transversely of said path, and having an outer end adapted to be coupled with an operating device, a gear mounted on said shaft and having a plurality of gear teeth in meshed engagement with said rack, each of said gear teeth presenting a cylindrical profile in a plane orthogonal to an axis of rotation of said gear, a stop on said panel adjacent said end of the rack, engageable by said gear and cooperating therewith to convert torque applied to said stop by said gear to a generally vertical force applied to said panel, structure engageable with said panel for providing a counterforce in response to said applied force, an elongated, tubular spacer receiving said shaft between said gear and said outer end for supporting said shaft against deflection under rotational load, and an inertia brake for holding said door panel against forward movement, said brake including a counterweight above said door panel having a braking position and a released position, an arm mounting said counterweight for movement between said braking position and said released position in response to normal opening of said door panel, and structure on said arm for engaging and holding said door panel when the counterweight is in its braking position and responds to a forward force indicative of a rapid halt of the car.

* * * * *